US005290146A

United States Patent [19]

Erber

[11] Patent Number: 5,290,146

[45] Date of Patent: Mar. 1, 1994

[54] OUTER CASING OF A LOW-PRESSURE PART OF A STEAM TURBINE

[75] Inventor: Rainer Erber, Waldshut-Gurtweil, Fed. Rep. of Germany

[73] Assignee: Asea Brown Boveri AG, Baden, Switzerland

[21] Appl. No.: 70,934

[22] Filed: Jun. 4, 1993

[30] Foreign Application Priority Data

Jun. 20, 1992 [EP] European Pat. Off. ..... 92110432.9

[51] Int. Cl.[5] ..... F01D 25/24; F01D 25/28

[52] U.S. Cl. ..... 415/213.1; 415/215.1

[58] Field of Search ..... 415/213.1, 214.1, 215.1

[56] References Cited

U.S. PATENT DOCUMENTS

| | | | |
|---|---|---|---|
| 3,642,380 | 2/1972 | Saunders | 415/213.1 |
| 3,843,281 | 10/1974 | Meylan et al. | 415/213.1 |
| 3,881,843 | 5/1975 | Meylan | 415/213.1 |

FOREIGN PATENT DOCUMENTS

| | | | |
|---|---|---|---|
| 0004392 | 10/1979 | European Pat. Off. . | |
| 3826508A1 | 2/1990 | Fed. Rep. of Germany . | |
| 57412 | 5/1977 | Japan | 415/213.1 |
| 63-097807 | 4/1988 | Japan . | |

*Primary Examiner*—Edward K. Look
*Assistant Examiner*—James A. Larson
*Attorney, Agent, or Firm*—Burns, Doane, Swecker & Mathis

[57] ABSTRACT

In an outer casing of a low-pressure part of a steam turbine, the casing lower part (2) consists of a foundation (5) shuttering, the split plane between the casing upper part (1) and the casing lower part (2) is arranged parallel to and below the horizontal plane through the turbine center line and this split plane and the condenser connection (4) are component parts of the foundation (5). The lower part (2) of the outer casing is not a load-bearing element. The force from the condenser (3) is introduced directly into the foundation (5). The efficiency of the part of the turbine is increased.

2 Claims, 1 Drawing Sheet

OUTER CASING OF A LOW-PRESSURE PART OF A STEAM TURBINE

BACKGROUND OF THE INVENTION

Field of the Invention

The invention relates to the welded outer casing of a low-pressure part of a steam turbine, which outer casing consists of an upper part and a lower part, with a condenser on the lower part which is connected to the foundation in such a way that expansion of the casing is possible.

Discussion of Background

Such outer casings of low-pressure steam turbines are known. They are embodied as welded constructions and consist of an upper part and a load-bearing lower part. The split plane between these two parts is located in the horizontal plane through the turbine center line.

The outer casing is located on the foundation by means of supports applied laterally over the complete length of the lower part. The supports are embodied in such a way that free expansion of the outer casing is possible.

The lateral central guidance of the outer casing is ensured by wedge guides on the foundation plates. The condenser is welded on underneath the load-bearing low-pressure lower part.

A disadvantage of this prior art is that the force from the condenser into the foundation is introduced via the load-bearing low-pressure part and the traction force due to the vacuum must be accommodated by the lower part. Because of this, it is necessary to install numerous rods and struts in the low-pressure lower part and this leads to a reduction in the efficiency. In addition, the necessary manufacture of the load-bearing low-pressure lower parts by sub-contractors and the associated transport of the very heavy and voluminous low-pressure lower parts has negative effects on the costs.

SUMMARY OF THE INVENTION

Accordingly, one object of this invention is to avoid all these disadvantages and to provide a novel low-pressure steam turbine outer casing which permits higher efficiency at reduced transport, material and assembly costs.

This is achieved, in accordance with the invention, because the lower part consists of foundation shuttering, because the split plane between the upper part and the lower part of the outer casing extends parallel to and below the horizontal plane through the turbine center line and because this split plane and the condenser connection are component parts of the foundation. It is advantageous for the distance between this split plane and the horizontal plane through the turbine center line to be approximately 1 meter. The support for the low-pressure outer casing/inner casing remains in the usual split plane.

The advantages of the invention are mainly based on the fact that the modified lower part of the outer casing of the low-pressure part of the turbine is, in contrast to the prior art, not a load-bearing lower part and does not therefore represent an outer casing lower part in the original sense. The advantages of the invention may be seen, inter alia, in the omission of the previously usual transport of the very heavy and large low-pressure lower parts. All the work can be carried out on the site with relatively simple components. There is a cost reduction of approximately 50%. Because the force from the condenser is introduced directly into the foundation and the traction force due to the vacuum can be accommodated by the lower part via the foundation, it is possible to reduce the rods and struts in the low-pressure lower part modified in accordance with the invention by approxiately 80% in comparison with the prior art. This increases the efficiency.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein an embodiment example of the invention is represented by means of a low-pressure part of a turbine. The single FIGURE shows a view (partial section) through the casing.

DESCRIPTION OF THE PREFERRED EMBODIMENTS

Figure 1:
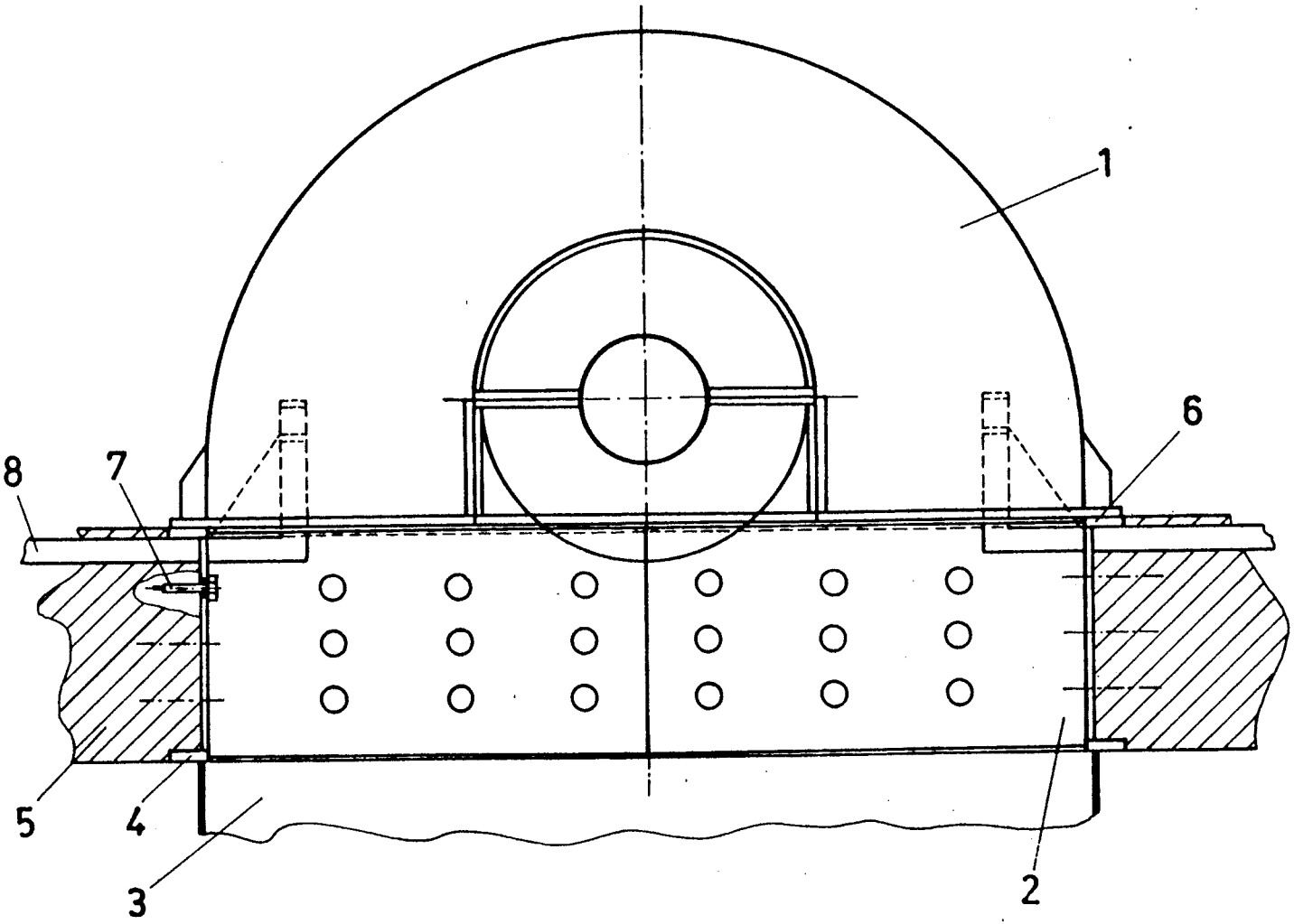

Referring now to the drawing, wherein only the elements essential for the understanding of the invention are shown, the outer casing of a low-pressure part of a steam turbine is shown in FIG. 1. It consists of a split casing upper part 1 and a modified casing lower part 2 in the form of empty shuttering for the foundation 5. The exhaust steam walls of the modified casing lower part 2 are connected to the foundation 5 by means of numerous anchoring elements 7 in such a way that expansion is possible. This is also achieved by the application of diaphragms. The support for the inner casing 8 of the low-pressure part of the turbine is fastened in the foundation 5. The condenser 3 is located beneath the modified lower part 2 of the low-pressure turbine and the condenser connection 4 is a direct component part of the foundation 5. The split plane 6 between the upper part 1 and the modified lower part 2 of the outer casing extends parallel to the horizontal plane through the turbine center line. The distance between these two planes is 1 meter. The height of the foundation 5 reaches as far as the split plane 6 between the upper part and the lower part, i.e. the split plane is a component part of the foundation 5.

The steam passes from the outlet of the medium-pressure part of the turbine via a transfer conduit directly into the low-pressure part of the turbine. It is there expanded down to the exhaust steam pressure and is subsequently precipitated in the condenser 3. Recesses are applied at the upper and lower end of the foundation 5 for de-aeration and dewatering of the gap between the foundation 5 and the exhaust steam walls of the modified lower part 2 of the turbine outer casing.

The lower part 2 of the outer casing of the low-pressure part of the turbine has no foundation supports of any type. In consequence, the force of the condenser 3 is no longer introduced via the low-pressure turbine lower part into the foundation 5. It is, on the contrary, introduced directly into the foundation 5. The traction force due to the vacuum can be accommodated by means of the foundation 5. As a result, the number of struts in the lower part can be kept very small and this increases the efficiency.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. An outer casing of a low-pressure part of a steam turbine, this outer casing consisting of an upper part and a lower part, with a condenser on the lower part which is connected to the foundation in such a way that expansion of the casing is possible, wherein the casing lower part consists of foundation shuttering, wherein the split plane between the upper part and the lower part of the outer casing extends parallel to and below the horizontal plane through the turbine center line and wherein this split plane and the condenser connection are component parts of the foundation.

2. The outer casing as claimed in claim 1, wherein the distance between the split plane and the horizontal plane through the turbine center line is approximately 1 meter.

* * * * *